US007140491B2

(12) United States Patent
Wang et al.

(10) Patent No.: US 7,140,491 B2
(45) Date of Patent: Nov. 28, 2006

(54) PACKAGING FOR GROUPED SIMILAR ITEMS, INCLUDING ELONGATED ITEMS SUCH AS DRILL BITS AND THE LIKE

(75) Inventors: Yuhong Wang, Shanghai (CN); Robert Yerkes, Palatine, IL (US)

(73) Assignee: TG Tools United Company, Saint Charles, IL (US)

( * ) Notice: Subject to any disclaimer, the term of this patent is extended or adjusted under 35 U.S.C. 154(b) by 0 days.

(21) Appl. No.: 10/783,507

(22) Filed: Feb. 20, 2004

(65) Prior Publication Data

US 2005/0082191 A1 Apr. 21, 2005

Related U.S. Application Data

(63) Continuation-in-part of application No. 10/685,920, filed on Oct. 15, 2003, now Pat. No. 6,902,064.

(51) Int. Cl.
*B65D 75/06* (2006.01)

(52) U.S. Cl. ..... 206/484; 206/730; 206/379; 206/443; 383/38; 383/40

(58) Field of Classification Search ..... 206/730, 206/379, 443, 459.5, 778, 484.2, 497, 806, 206/484; 383/38–40, 109
See application file for complete search history.

(56) References Cited

U.S. PATENT DOCUMENTS

| | | | | | |
|---|---|---|---|---|---|
| 2,344,369 | A | * | 3/1944 | Salfisberg | 383/109 |
| 2,401,110 | A | * | 5/1946 | Rohdin | 383/38 |
| 2,741,559 | A | * | 4/1956 | Banowitz | 426/120 |
| 2,788,121 | A | | 4/1957 | Ayres | |
| 3,307,686 | A | | 3/1967 | Brecher | |
| 3,638,784 | A | | 2/1972 | Bodolay et al. | |
| 3,762,628 | A | | 10/1973 | Sargent | |
| 3,844,409 | A | * | 10/1974 | Bodolay et al. | 206/459.5 |
| 3,939,972 | A | | 2/1976 | Mayworm | |
| 4,720,040 | A | * | 1/1988 | Gurewitz | 232/1 D |
| 4,744,673 | A | * | 5/1988 | Nakamura | 383/38 |
| 5,024,536 | A | * | 6/1991 | Hill | 383/38 |
| 5,097,949 | A | * | 3/1992 | Heldwein | 206/720 |
| 5,388,699 | A | * | 2/1995 | Ratajczak et al. | 206/569 |
| 5,881,883 | A | | 3/1999 | Siegelman | |
| 6,575,627 | B1 | * | 6/2003 | Huseman et al. | 383/38 |
| 2002/0067865 | A1 | * | 6/2002 | Stutzman | 383/38 |
| 2004/0179754 | A1 | * | 9/2004 | Taheri | 383/38 |

OTHER PUBLICATIONS

Photo of package for Weller Tip Solder, sold at least as early as Oct. 1, 2002.
Photo of package for Wolfcraft Shaker Pegs, sold at least as early as Oct. 1, 2002.
Photo of package for RotoZip Bits, sold at least as early as Oct. 1, 2002.
Photo of package for DeWalt driver bits, sold at least as early as Oct. 1, 2002.
Photo of package for Bosch drill bits, sold at least as early as Oct. 1, 2002.

* cited by examiner

*Primary Examiner*—Mickey Yu
*Assistant Examiner*—Jerrold Johnson
(74) *Attorney, Agent, or Firm*—Greenberg Traurig

(57) ABSTRACT

A package for like articles, especially elongated articles, such as drill bits and the like, is provided with a plurality of compartments or sectioned off regions, for the containment of an individual article for substantially unfettered visual inspection; for the containment of a further plurality of articles identical to the exposed visual article, and for indicia as required by the manufacturer and/or required by law. The package is configured to be presented in a hanging manner from retail display shelving.

15 Claims, 12 Drawing Sheets

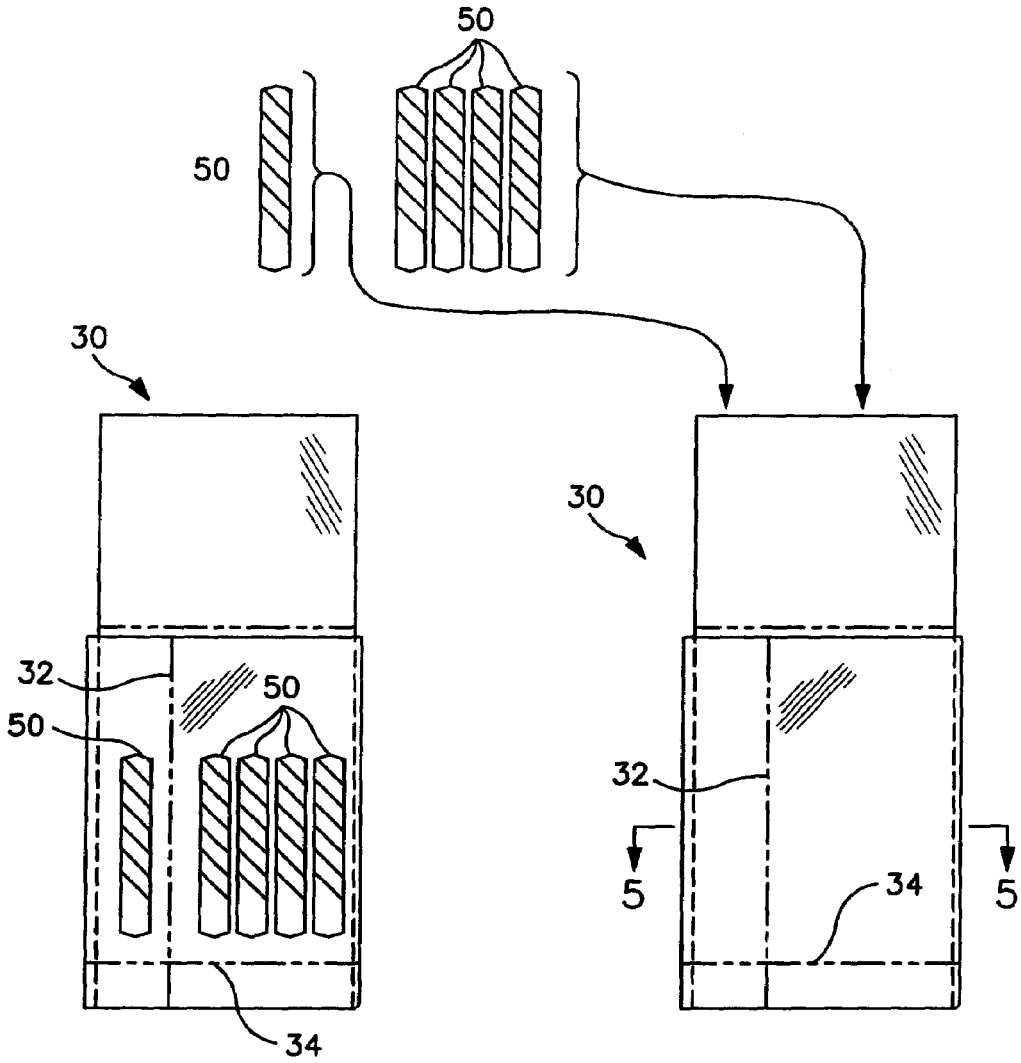
FIG. 6
FIG. 4
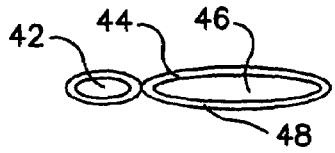
FIG. 5

PACKAGING FOR GROUPED SIMILAR ITEMS, INCLUDING ELONGATED ITEMS SUCH AS DRILL BITS AND THE LIKE

This application is a continuation-in-part of Ser. No. 10/685,920, filed Oct. 15, 2003, now U.S. Pat. No. 6,902, 064.

BACKGROUND OF THE INVENTION

1. The Technical Field

The present invention is directed to packaging for grouped similar items, including elongated items such as drill bits or the like, and further including packaging adapted to be hung from retail shelving.

2. The Prior Art

There are many ways to package and present in a retail environment, elongated items, such as drill bits, jigsaw blades and the like, including skin cards, clamshell blister packs, plastic bags, and molded or stamped boxes. Such elongated items may be sold in a variety of basic ways: the single article (or at most 2–3 if small) in a package; a quantity of, e.g. 5–10 identical articles in a package; an organized set of different, but related articles (e.g., a set of an indeterminate number of articles of varying size, grade, etc.).

Presenting a single article in a package may be advantageous, in that in a transparent package, e.g., a bag or skin card, all or substantially all of the surface of the individual article may be exposed for visual inspection or even (in a thin bag or wrapper) tactile inspection.

However, single article packaging can be problematic in that it can occupy more storage and shipping volume that a comparable number of like articles packaged in bunches. Furthermore, if a customer is purchasing a large quantity of single articles, there can be more checkout time involved.

However, plural article packaging can be problematic as well, for elongated articles such as drill bits and the like. Such packaging may typically may be fabricated from plastic or paper. Plastic may be difficult to affix identifying and marketing indicia, consumer information and the like in a manner which does not obscure the visibility of the products inside. Paper may permit indicia placement but likewise typically obscures visibility of the articles being presented.

It would be desirable to provide a method for packaging plural identical articles, such as elongated articles like drill bits, which has the advantages of single article packaging, such as enabling visual inspection of the articles.

It would also be desirable to provide a method for packaging of plural identical articles, which provides for the placement of such indicia as may be desired by the manufacturer or required by law, while still permitting visual inspection.

These and other desirable characteristics of the present invention will become apparent in view of the present specification, including claims, and drawings.

SUMMARY OF THE INVENTION

The present invention comprises in part, a package of a plurality of like articles, having a longitudinal axis and a transverse axis. The package comprises a first sleeve, having a length, a top end and a bottom end; and a second sleeve, insertingly received within the first sleeve and having a length greater than the length of the first sleeve, a top end and a bottom end, so that the first sleeve overlaps at least a portion of the second sleeve in a region of overlap.

A first closure line extends along at least a portion of the region of overlap. The first closure line joins longitudinally extending inner surfaces of the first sleeve to adjacent longitudinally extending outer surfaces of the second sleeve, and opposing longitudinally extending inner surfaces of the second sleeve to each other, A second closure line extends transversely across at least a portion of the region of overlap. The second closure line joins transversely extending inner surfaces of the first sleeve to adjacent transversely extending outer surfaces of the second sleeve, and opposing transversely extending inner surfaces of the second sleeve to each other;

The first and second closure lines define first and second chambers in the second sleeve, the first chamber being larger than the second chamber, and third and fourth chambers between the first and second sleeves, on opposite sides of the first chamber in the second sleeve.

A plurality of articles are disposed in the first chamber, and a single article is disposed in the second chamber.

A third closure line extends transversely across the second sleeve in a region beyond the region of overlap, and joins transversely opposing inner surfaces of the second sleeve, with the plurality of articles and the single article being disposed between the second and third closure lines, to maintain the plurality of articles and the single article captured within the first and second chambers, respectively.

In a preferred embodiment of the invention, each of the first and second sleeves is one of: transparent, translucent.

The package preferably further comprises at least one sheet disposed in at least one of the third and fourth chambers disposed between the first and second sleeves, on opposite sides of the first chamber in the second sleeve. The at least one sheet preferably has indicia disposed thereon.

The package preferably further comprises a fifth chamber, disposed between the third closure line and the top of the second sleeve. A reinforcement sheet is disposed in the third chamber between the third closure line and the top of the second sleeve. A fourth closure line is disposed between the reinforcement sheet and the top of the second sleeve, to maintain the reinforcement sheet captured between the third and fourth closure lines. An aperture is formed through the second sleeve and the reinforcement sheet, for enabling the package to be suspended by a member passing through the aperture.

Preferably, the top end of the second sleeve is longitudinally spaced apart from the top end of the first sleeve. The bottom end of the second sleeve is preferably disposed proximate the bottom end of the first sleeve. The second sleeve preferably has a width which is less than the width of the first sleeve.

The plurality of articles disposed in the first chamber are preferably all like articles, and the single article disposed in the second chamber is the same as one of the plurality of like articles. Preferably, the first and second sleeves comprise substantially flattened tubes.

The present invention also comprises, in part, a method for forming a package, the package having a longitudinal axis and a transverse axis. The method comprising the steps of:

forming a first sleeve, having a length, a top end and a bottom end;

forming a second sleeve, having a length greater than the length of the first sleeve, a top end and a bottom end;

inserting the second sleeve into the first sleeve, so that the first sleeve overlaps at least a portion of the second sleeve in a region of overlap;

forming a first closure line, extending along at least a portion of the region of overlap, to join longitudinally extending inner surfaces of the first sleeve to adjacent longitudinally extending outer surfaces of the second sleeve, and opposing longitudinally extending inner surfaces of the second sleeve to each other, forming a second closure line, extending transversely across at least a portion of the region of overlap, to join transversely extending inner surfaces of the first sleeve to adjacent transversely extending outer surfaces of the second sleeve, and opposing transversely extending inner surfaces of the second sleeve to each other;

the first and second closure lines defining first and second chambers in the second sleeve, the first chamber being larger than the second chamber, and third and fourth chambers between the first and second sleeves, on opposite sides of the first chamber in the second sleeve;

placing a plurality of articles in the first chamber;

placing a single article in the second chamber;

forming a third closure line, extending transversely across the second sleeve in a region beyond the region of overlap, to join transversely opposing inner surfaces of the second sleeve, with the plurality of articles and the single article being disposed between the second and third closure lines, to maintain the plurality of articles and the single article captured within the first and second chambers, respectively.

The steps of forming the first and second sleeves, preferably further comprise the step of forming each of the first and second sleeves from one of transparent or translucent material.

The method preferably further comprises the step of:

placing at least one sheet in at least one of the third and fourth chambers disposed between the first and second sleeves, on opposite sides of the first chamber in the second sleeve.

The method preferably further comprises the step of placing indicia on the at least one sheet.

The method preferably further comprises the steps of:

forming a fifth chamber, disposed between the third closure line and the top of the second sleeve;

placing a reinforcement sheet in the third chamber between the third closure line and the top of the second sleeve;

forming a fourth closure line, between the reinforcement sheet and the top of the second sleeve, to maintain the reinforcement sheet captured between the third and fourth closure lines; and forming an aperture through the second sleeve and the reinforcement sheet, for enabling the package to be suspended by a member passing through the aperture.

The method preferably further comprises the step of:

positioning the top end of the second sleeve in longitudinally spaced apart relation to the top end of the first sleeve.

The method preferably further comprises the step of:

positioning the bottom end of the second sleeve proximate the bottom end of the first sleeve.

The method preferably further comprises the step of:

forming the second sleeve with a width which is less than the width of the first sleeve.

The method preferably further comprises the steps of:

selecting the plurality of articles disposed in the first chamber to be all like articles, and selecting the single article disposed in the second chamber to be the same as one of the plurality of like articles.

Preferably, the first and second sleeves are formed as substantially flattened tubes.

The invention further comprises in part, a package of a plurality of like articles, having a longitudinal axis and a transverse axis. First and second inner layers are provided, each having a width, extending along the transverse axis, and a height, extending along the longitudinal axis. The first and second inner layers are joined to one another along at least three longitudinally extending closure lines to form at least two inner chambers, for receiving articles to be packaged, the at least two inner chambers being bounded by the at least three closure lines and the first and second inner layers. The first and second inner layers are joined at least along respective bottom edge regions thereof. First and second outer layers are provided, each having a width, extending along the transverse axis, and a height extending along the longitudinal axis. The first and second outer layers are disposed adjacent the first and second inner layers, respectively. The first and second outer layers are joined to their respective adjacent first and second inner layers along at least two longitudinally extending closure lines to form at least one outer chamber. The first and second outer layers are joined, at least indirectly, at least along respective bottom edge regions thereof. A plurality of articles is disposed in at least one of the at least two inner chambers, and a number of articles is disposed in an other one of the at least two inner chambers, less than the plurality of articles disposed in the at least one of the at least two inner chambers.

In an embodiment of the invention, the first and second inner layers are contiguously, monolithically formed together along their respective bottom edge regions. Alternatively, the first and second inner layers may comprise separate sheets of material that have been sealed together along their respective bottom edge regions.

The first and second outer layers may be contiguously, monolithically formed together along their respective bottom edge regions. Alternatively, the first and second layers may comprise separate sheets of material that have been sealed together along their respective bottom edge regions.

Each of the first and second inner layers and first and second outer layers is one of: transparent, translucent, opaque.

The package may further comprise at least one sheet disposed in at least one outer chamber. The at least one sheet may have indicia disposed thereon.

The package preferably further comprises a further closure line, extending transversely across and sealing joining top edge regions of the first and second inner layers.

The top edge regions of the first and second inner layers are preferably longitudinally spaced apart from top edge regions of the first and second outer layers.

The bottom edge regions of the first and second inner layers are preferably disposed proximate the bottom edge regions of the first and second outer layers.

The first and second outer layers may have widths that are less than the widths of the first and second inner layers.

The plurality of articles disposed in the at least one of the at least two inner chambers, may be all like articles, and the number of articles disposed in the other one of the at least two inner chambers may be the same as those of the plurality of like articles.

The present invention also comprises, in part, a method for forming a package of a plurality of like articles, having a longitudinal axis and a transverse axis, the method comprising the steps of:

forming first and second inner layers, each having a width, extending along the transverse axis, and a height, extending along the longitudinal axis, joining the first and second inner layers to one another along at least three longitudinally extending closure lines to form at least two inner chambers, for receiving articles to be packaged, the at least two inner chambers being bounded by the at least three closure lines and the first and second inner layers, joining the first and second inner layers at least along respective bottom edge regions thereof;

forming first and second outer layers, each having a width, extending along the transverse axis, and a height extending along the longitudinal axis, disposing the first and second outer layers adjacent the first and second inner layers, respectively, joining the first and second outer layers to their respective adjacent first and second inner layers along at least two longitudinally extending closure lines to form at least one outer chamber, joining the first and second outer layers, at least indirectly, at least along respective bottom edge regions thereof;

placing a plurality of articles in at least one of the at least two inner chambers, and placing a number of articles in an other one of the at least two inner chambers, less than the plurality of articles disposed in the at least one of the at least two inner chambers.

The method may further comprise the step of contiguously, monolithically forming the first and second inner layers together along their respective bottom edge regions. The method may alternatively further comprise the step of forming the first and second inner layers as separate sheets of material that have been sealed together along their respective bottom edge regions.

The method may comprise the step of contiguously, monolithically forming the first and second outer layers together along their respective bottom edge regions. The method may alternatively further comprise the step of forming the first and second layers as separate sheets of material that have been sealed together along their respective bottom edge regions.

The method may further comprise the step of forming each of the first and second inner layers and first and second outer layers as one of: transparent, translucent, opaque.

The method may further comprise the step of placing at least one sheet in at least one outer chamber, and may also comprise the further step of placing indicia on the at least one sheet.

The method may further comprise the step of forming a further closure line, extending transversely across and sealing joining top edge regions of the first and second inner layers.

The method may further comprise the step of positioning the top edge regions of the first and second inner layers in longitudinally spaced apart relationship from top edge regions of the first and second outer layers.

The method may further comprise the step of positioning the bottom edge regions of the first and second inner layers proximate the bottom edge regions of the first and second outer layers.

The method may further comprise the step of providing the first and second outer layers with widths that are less than the widths of the first and second inner layers, and may further comprise the steps of selecting the plurality of articles disposed in the at least one of the at least two inner chambers, to be all like articles, and selecting the number of articles disposed in the other one of the at least two inner chambers to be the same as those of the plurality of like articles.

BRIEF DESCRIPTION OF THE DRAWINGS

FIG. 4 is an elevation of the assembly of FIG. 3, shown further along the fabrication process.

FIG. 5 is a sectional view of the assembly of FIG. 4, taken along line 5—5 of FIG. 4.

FIG. 6 is an elevation of the assembly of FIG. 4, showing the insertion of elongated articles into respective receiving chambers of the package in formation.

DETAILED DESCRIPTION OF THE INVENTION

Figure 1:
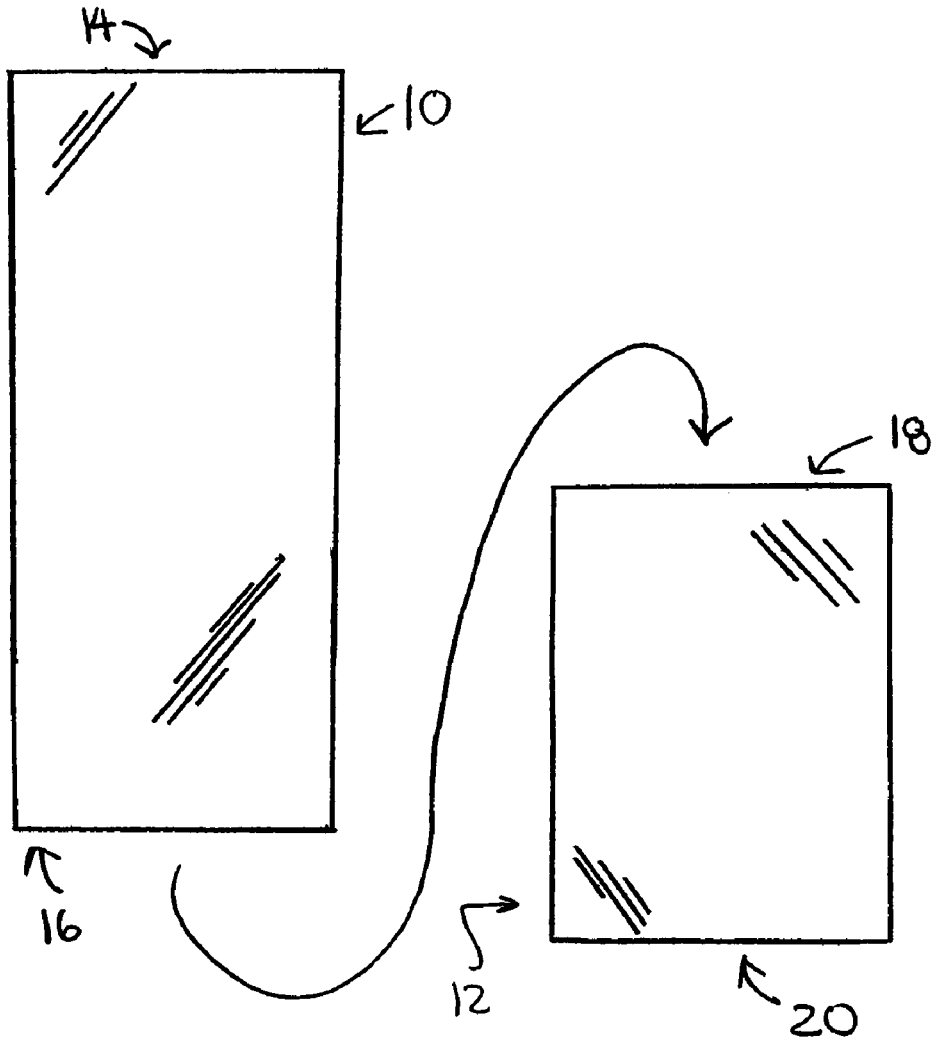
FIG. 1 is an elevation of two components of a package for similar articles, according to a preferred embodiment of the invention.
Figure 2:
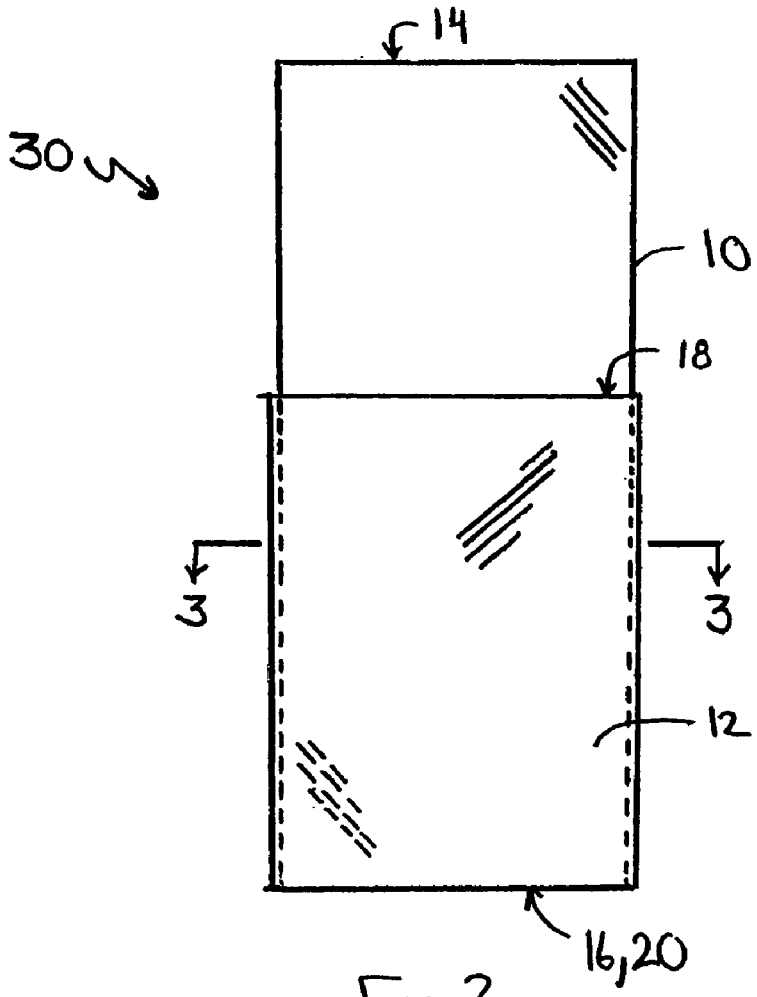
FIG. 2 is an elevation of the two components of FIG. 1 in partially assembled configuration.
Figure 3:
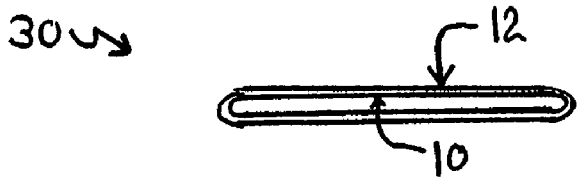
FIG. 3 is a sectional view of the assembly of FIG. 2, taken along line 3—3 of FIG. 2.

While this invention is susceptible of embodiment in many different forms, there is shown in the drawings and will be described in detail several specific embodiments, with the understanding that the present disclosure is to be considered an exemplification of the principles of the invention and is not intended to limit the invention to the embodiments illustrated.

A package for a plurality of similar articles according to a preferred embodiment of the invention is formed first, as shown in FIG. 1, by forming two sleeves 10 and 12, each of which is preferably formed (e.g., by cutting to desired length), tubular plastic material (of any suitable type—typically cut from a roll of flattened tube), which are preferably transparent, or alternatively translucent, but which will permit visual inspection of anything within the respective sleeves.

Sleeve 10 includes open ends 14 and 16, while sleeve 12 includes open ends 16 and 18. The material of sleeves 10 and 12 is preferably susceptible to welding to itself, e.g., by pressure, heat, microwave or ultrasonic vibrations. Sleeve 10 is inserted into sleeve 12 which preferably has a circumference which is slightly greater than the circumference of sleeve 10, in order to facilitate the insertion of sleeve 10 into sleeve 12. Alternatively, sleeve 10 may have a circumference that is the same as or greater than that of sleeve 12, though this may make insertion of sleeve 10 into sleeve 12 more difficult, as well as making later fabrication steps slightly more difficult. In addition, sleeve 10 has a length which is preferably substantially greater than the length of sleeve 12.

Upon insertion, sleeves 10 and 12 form assembly 30, in which open end 16 of sleeve 10 is preferably substantially aligned with the end 20 of sleeve 12, although the respective ends may be unaligned if desired.

The third stage of the package formation occurs when welds 32 and 34 are provided, extending through both sleeves 10 and 12, to form assembly 40, creating chambers 42, 44, 46, and 48. Weld 34 closes off the bottoms 16 and 20 of sleeves 10, 12, respectively, while weld 32 creates a vertical separation of the volume within sleeve 10. Preferably, weld 32 is off-center, so that chamber 42 is appropriately sized for a single article 50, while chamber 46 is appropriately sized to receive a plurality of like articles 50.

Although chambers 44, 48 are, strictly speaking, contiguous, because of the fact that they are, due to the typically flattened nature of sleeves 10, 12, on generally opposite sides of chamber 46, it is useful to consider them as separate and discrete chambers. In instances in which the bulk of the articles being packaged causes the package to assume a less than flattened configuration, it may be desirable to provide further welds, extending longitudinally at the sides of the region of overlap of tubes 10, 12, so that fully discrete and discontinuous chambers are created.

While welds, as described above are preferably used to create the separations between the various chambers of the package described herein, as being the most efficient and amenable to manufacturability, other methods of creating the welds (or closure lines) may be employed, such as staples or stitching, for example. Further, the welds or closure lines, while preferably extending continuously and completely across the height or width of the respective sleeves to which they are applied, may instead be intermittent, and may stop short of peripheral edges of the respective sleeves or at other locations, so long as the function of restraining the articles being packaged within their respective regions is accomplished.

Articles 50 are inserted into chambers 42, 46, after welds 32, 34 have been accomplished. Articles 50 are shown representationally as drill bits, but may be any elongated articles (e.g., center punches, etc.). Even non-elongated articles may be accommodated, by suitably modifying the relative dimensional proportions of the chambers created by the overlapped sleeves and the subsequently created welds.

After the articles 50 have been inserted, they are sealed in place by weld 52, which extends across sleeve 10, but does not contact the top of sleeve 12, thus leaving the tops of chambers 44, 48 still open, and as well leaves the top of sleeve 10, above weld 52, likewise open for insertion of further items. Sheets 54, 56 may be provided with various indicia (product name, product information, UPC bar code(s), etc.) as desired or required by law. Sheets 54, 56 may be fabricated from any suitable material capable of bearing indicia, and once prepared and suitably printed, are inserted into chambers 44, 48, respectively.

Figure 7:
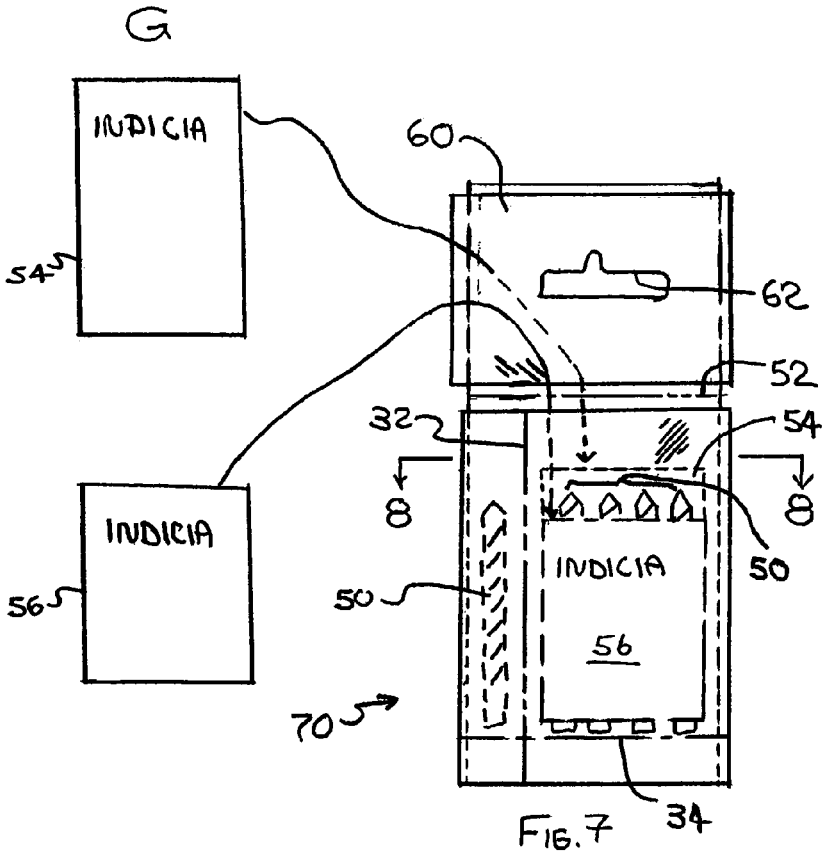
FIG. 7 is an elevation of the assembly of FIG. 6, showing the insertion of indicia bearing sheets, as well as a reinforcement sheet for enabling the hanging display of the package.
Figure 8:
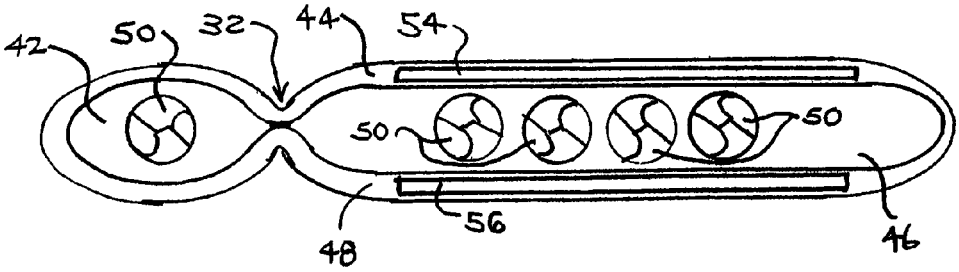
FIG. 8 is an enlarged sectional view of the assembly of FIG. 7, taken along line 8—8 of FIG. 7.

As the side shown in FIG. 7 is preferably the nominal "front" of the package, it is intended to be placed on a shelf, so that sheet 56 faces front. Sheet 56 preferably is "shorter" than the articles 50 (e.g., drill bits), so that the tops of the articles will be visible, while sheet 54 may or may not be of equal or greater length than articles 50. Sheet 54 will be rotated 180 degrees (as indicated by the arrow), so that its indicia face to the rear (although either sheet may be provided with indicia on both sides, as necessary or desired).

Once sheets 54, 56 have been inserted, a further weld may be placed across the tops of chambers 44, 48. However, in usual practice this may not be necessary, as sheets 54, 56 will be sized so that the fit of each within its respective chamber 44, 48 will be sufficiently snug enough that sheets 54, 56 will not fall out, subsequent to fabrication, to prevent sheets 54, 56 from being dislodged during shipment, through placement on retail shelving, up to purchase by a consumer.

The placement of sheets 54, 56 in the chambers 44, 48, rather than immediately adjacent to articles 50 is advantageous, in that articles 50, which may be, e.g., drill bits or other tool parts, may be coated with oil or other materials, for example, to prevent rusting or other damage to the articles, pending purchase by the consumer. This coating may be harmful or detrimental to the indicia that is printed on the sheets, in that it may blur the printing or adversely affect the material of the sheets themselves. By placing the sheets 54, 56 within chambers 44, 48, they are isolated from the articles, and cannot be affected by them or any coating or the like.

After placement of the sheets, and possible, though not required, welding of the tops of chambers 44, 48, the package is then prepared for hanging. Depending upon the strength of the material, the top of sleeve 10 may be simply closed by a further weld 58. Alternatively, a further sheet 60 (which may or may not also have indicia placed on it) is inserted above weld 52, prior to placement of weld 58, to provide reinforcement strength for enabling the package to be hung on a peg, rod or hook. Once in place, a hole 62 is formed through the layers of sleeve 10 and sheet 60, in any suitable shape that is appropriate for enabling the completed package 70 to be hung via a peg or hook, from a retail display shelf. Depending upon the characteristics of the particular materials from which sleeve 10 and sheet 60 are fabricated, the act of die cutting hole 62 may serve to press onto or microweld the layers of sleeve 10 to the sides of sheet 60, proximate to hole 62, so that the edges of sleeve 10 that define hole 62 are not loose, but more or less affixed to sheet 60.

A further vertical weld 64 may be provided if desired, to prevent sheet 60 from migrating laterally, and to obviate the need for sheet 60 to extend across the entire width of the top of sleeve 10. Alternatively, sheet 60 may be made to have a width approximately equal to the width of sleeve 10.

Package 70 has the advantage of providing for the packaging of a plurality of like articles in a compact and economic manner, while at the same time displaying a single representative one of the articles in a complete manner for unencumbered visual inspection. Furthermore, package 70 enables indicia such as product information to be provided in a manner which is not interfered with by the articles being packaged.

While in preferred embodiments of the invention, in the package, the articles packaged are all identical or substantially so, in alternative embodiments of the invention, one or more of the articles may be non-identical.

Figure 9:
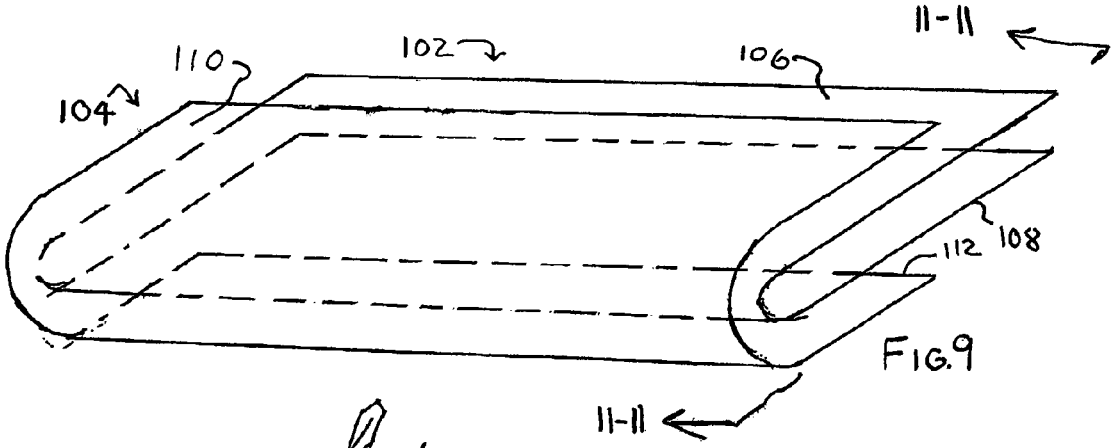
FIG. 9 is a perspective exploded view of two components of a package for similar articles, according to an alternative preferred embodiment of the invention.
Figure 10:
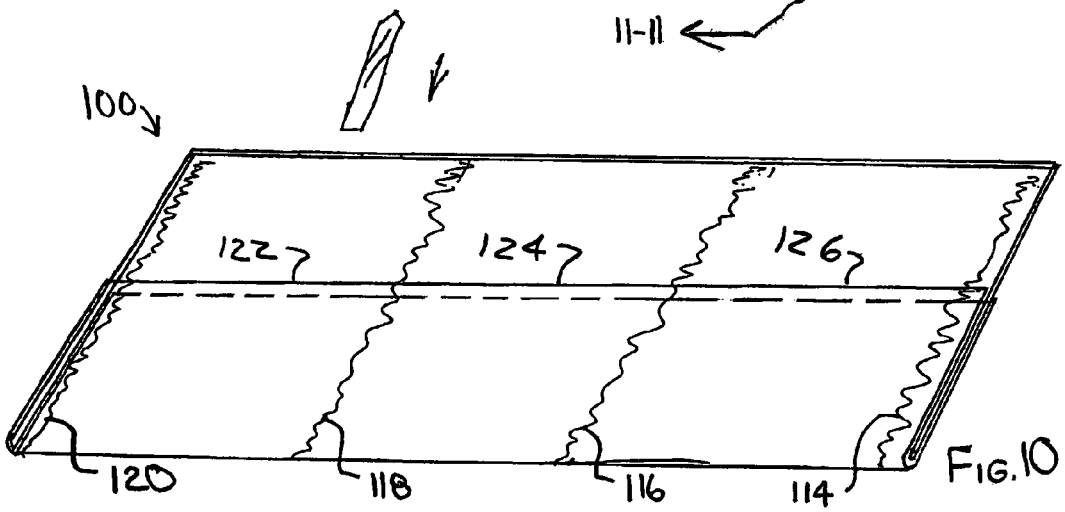
FIG. 10 is a perspective view of a package according to the embodiment of FIG. 9, with the indicia bearing sheets and articles to be packaged omitted.
Figure 11:
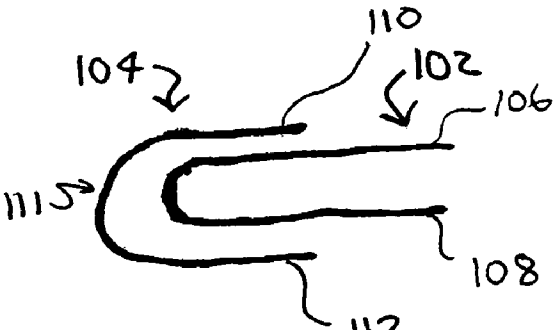
FIG. 11 is a side elevation of the exploded assembly of FIG. 9.

FIGS. 9–11 illustrate components and an assembly thereof, for a package according to an alternative embodiment of the invention. In this embodiment the package may be formed from two sheets 102, 104 of plastic (or similar) transparent material. The articles being packaged, and the indicia bearing sheets of the prior embodiments have been omitted from the illustrations, but are understood to be present in finished packages fabricated in accordance with the description hereinafter.

Sheets 102, 104 preferably have the same width, but sheet 102 is longer than sheet 104. Sheet 102 is folded upon itself, to form legs 106, 108, while sheet 104 is folded about sheet 102, to form legs 110, 112. Thereafter, seams (or closure lines) 114, 116, 118 and 120 are formed by heat, ultrasonic or RF (radio frequency) waves, through all layers of sheets 102, 104, to form three long inner chambers across, between legs 106 and 108; three outer short chambers across between legs 106 and 110; and three short outer chambers across between legs 108 and 112. For example, edges 122, 124 and 126 define the mouths of the three short chambers on the upper side of package 100, as seen in FIG. 9.

In the embodiment of FIGS. 9–11, the outer sheet 104 is folded about inner sheet 102 in such a manner that the free edges of legs 110, 112 of sheet 104 are the same distance from the fold 111. In alternative embodiments, sheet 104 may be shifted so that the free edges of legs 110, 112 are at different distances from the fold. Furthermore, while in the embodiment of FIGS. 9–11, three sets of three chambers extending across the width of package 100 are shown, it is to be understood that one of the seams (e.g., 118) may be omitted, to provide for two chambers extending across, or that more seams may be provided, without departing from the scope of the invention.

Figure 21:
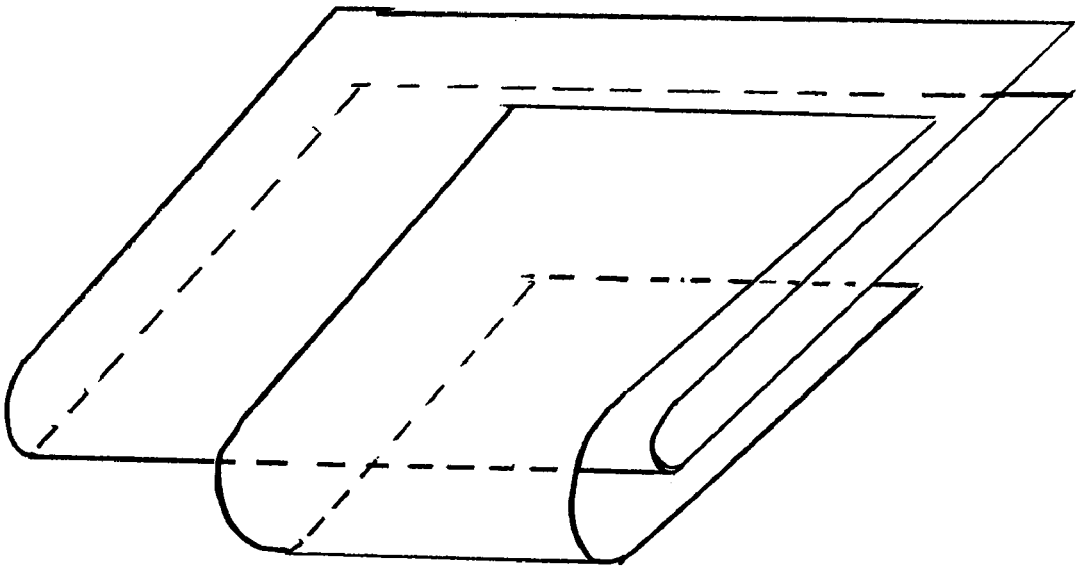
FIG. 21 is a perspective view of an unassembled package according to an alternative embodiment in which the outer layer has a lesser width than the inner layer.
Figure 22:
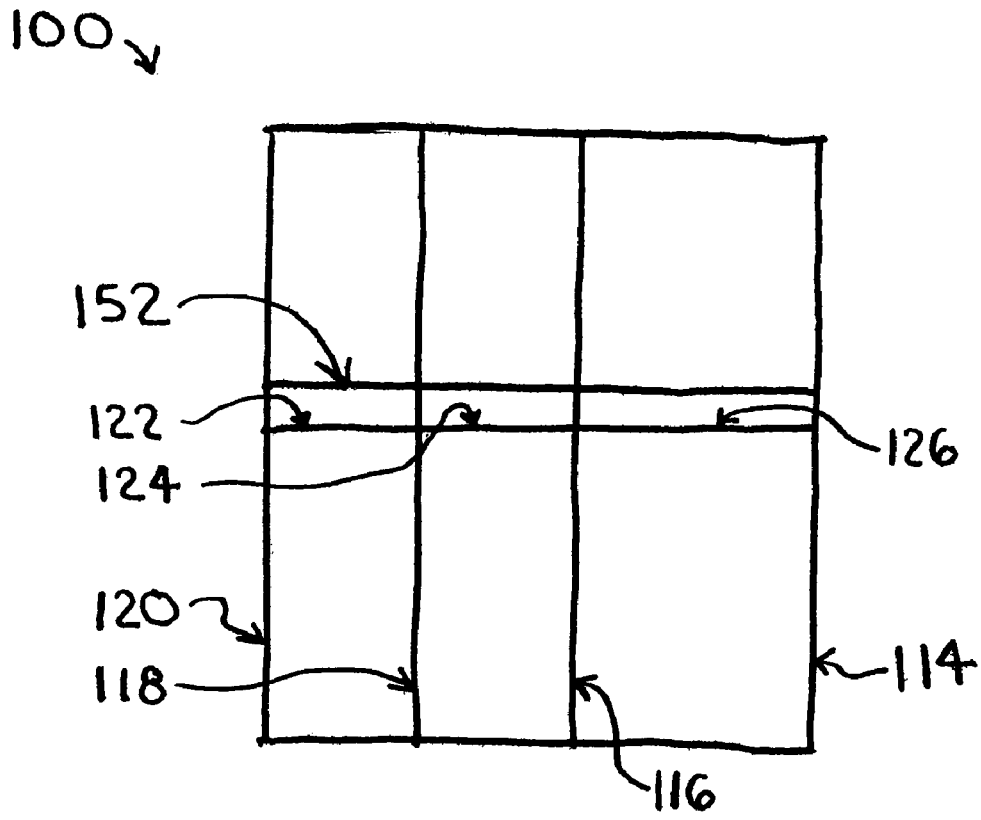
FIG. 22 is a front elevation of an assembled package according to the embodiment of FIG. 10, with the packaged articles and Indicia bearing sheets being omitted for clarity of illustration.

One or more articles, such as drills 122 (FIG. 10) may be inserted into one or more of the inner chambers between legs 106 and 108, preferably in the manner described with respect to the previously described embodiments, wherein a plurality of like articles are placed in one or two of the long chambers, while a one or two exemplary articles are placed by themselves in a separate one of the chambers. For example, a package constructed according to FIGS. 9–11 may have in one long chamber a group of several examples of a particular style or model of article; in another long chamber, a group of several examples of another particular style or model of article, and in a third long chamber, one example of each. Thereafter, a further seam (not shown) may be placed across the entire width (or some lesser part thereof) of the aligned free edges of legs 106, 108, to capture the articles received in the chambers. Indicia bearing cards may be placed in one or more of the short chambers formed between legs 106, 110, and 108, 112, respectively, while preferably not in the short chambers adjacent to the long chamber containing the single (or small number) of examples of the groups of articles enclosed in the other long chambers. FIG. 22 illustrates an assembled version of a package 100 according to the embodiment of FIGS. 9–11, but with the articles and indicia bearing sheets omitted for clarity. Once the articles (not shown) have been Inserted into the various chambers, a permanent seal 152 is provided (analogous to seal 52 of the embodiment of FIGS. 1–8), between legs 106, 108 (see FIGS. 9–11), to capture the articles in the respective chambers. A further permanent seal may also be provided across the tops of legs 106, 108. Similar permanent welds (not shown) will be provided as appropriate in the embodiments of FIGS. 12–21 herein. In alternative embodiments, sheet 104 (or the corresponding separate outer layer sheets of the subsequently described embodiments) may have a width that is less than the width of sheet 102 (or the corresponding separate inner layer sheets of the subsequently described embodiments) to define a fewer number of outer chambers, than of inner chambers. Such an embodiment is illustrated in unassembled form in FIG. 21.

Figure 23:
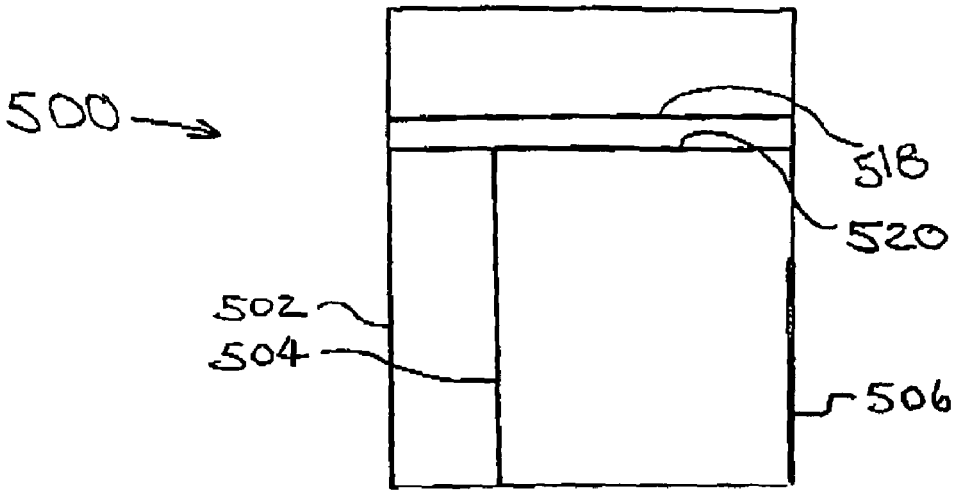
FIG. 23 is a front elevation of an assembled package (in which the articles packaged have been omitted to facilitate illustration), according to a further embodiment of the invention.
Figure 24:
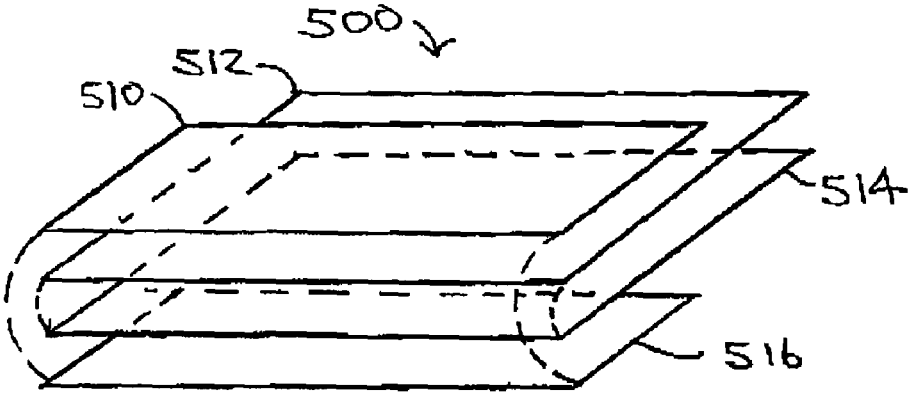
FIG. 24 is a perspective view of the unassembled package according to the embodiment of FIG. 23, showing the different ways in which the package may be formed.

FIGS. 23 and 24 illustrate a further embodiment of the invention, wherein the package 500 (in which the packaged articles have been omitted to facilitate illustration), similar to the embodiment of FIGS. 1–8. has three vertical welds 502, 504 and 506, to form two outer chambers on the front two outer chambers on the back, and two inner chambers. Weld 504, being substantially closer to weld 502 than to weld 504, creates two outer chambers that have widths substantially less than the other two outer chambers, and one inner chamber that has a width that is substantially less than the other inner chamber, to facilitate the packaging of a quantity of articles in the larger inner chamber, and an indica bearing card or cards, in the two larger outer chambers, with a smaller number of articles, or even a single article (of the same type as in the larger inner chamber) in the smaller inner chamber, for facilitating inspection and display of the articles. Package 500 may be formed from a sandwich of four sheets 510, 512, 514, 516 (as shown in solid lines in FIG. 24, similar to the embodiment of FIGS. 18 and 19), wherein the outer sheets 510, 516 are "shorter"than inner sheets 512, 514, Alternatively, package 500 may be formed by one or two folded over sheets, wherein sheets 510, 516 may be the front and rear faces of a single folded-over sheet (as indicated by the broken lines in FIG. 24), and/or sheets 512, 514 may be the front and rear faces of a single folded-over sheet(also as indicated by the broken lines in FIG. 24) similar to the embodiments of FIGS. 11, 14 or 17. Welds 502, 504 and 506 preferably will join all four layers. While horizontal weld 518 will join only the innermost two layers (after insertion of the articles, not shown), being located above the upper edges (e.g., edge 520 of layer/sheet 510 of the outermost layers of package 500. While the embodiment of FIGS. 23 and 24 has only two inner chambers, it is to be understood that in an alternative embodiment (similar to FIGS. 18 and 19), a wider package, having a further vertical weld, may be provided, of whatever desired width, so long as there is an inner chamber having a width substantially less than any of the other inner chambers, without departing from the scope of the present invention.

In the embodiments shown in FIGS. 9–20, the inner and outer chambers all have approximately the same width, due to the substantially equidistant spacing between the longitudinal seams. However, it is understood that the spacing between the seams may be varied so that, for example, one inner chamber is substantially wider or narrower than the other(s) of the inner chambers, again for purposes of providing one example of an article being packaged set off from a group of others of the same article, for permitting thorough inspection of the individually set-off article.

Figure 14:
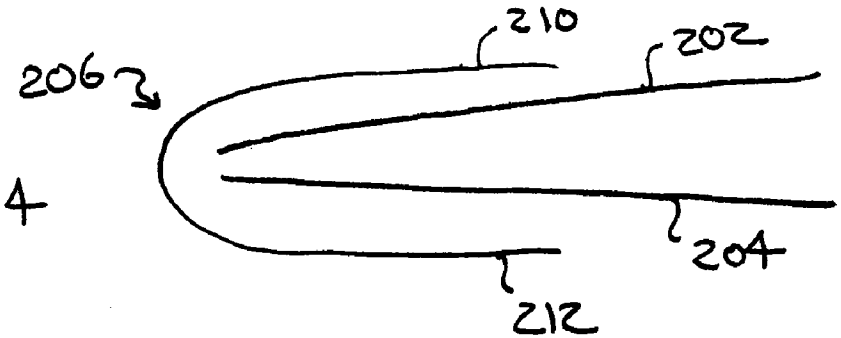
FIG. 14 is a side elevation of the exploded assembly of FIG. 12.
Figure 12:
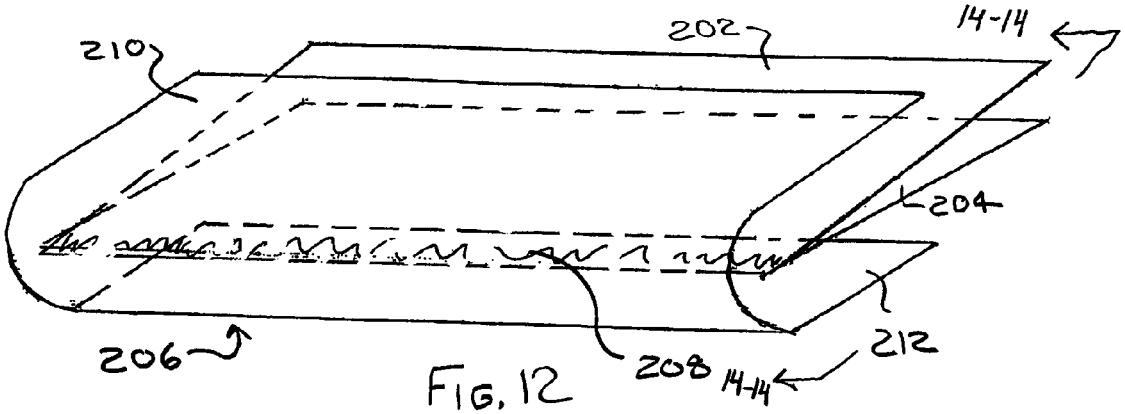
FIG. 12 is a perspective exploded view of two components of a package for similar articles, according to an another alternative preferred embodiment of the invention.
Figure 13:
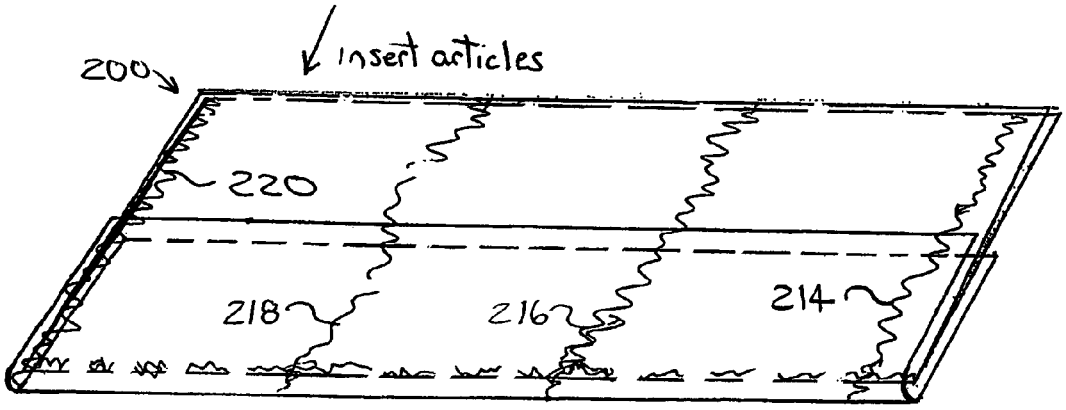
FIG. 13 is a perspective view of a package according to the embodiment of FIG. 12, with the indicia bearing sheets and articles to be packaged omitted.

FIGS. 12—14 illustrate another alternative embodiment of the invention, wherein a package similar to that of FIGS. 9–11 is formed from three sheets of plastic material. Package 200 is formed from sheets 202, 204 and folded sheet 206. Sheets 202, 204 are joined together along their respective bottom edges at seam 208, as shown in FIGS. 12 and 14, and then sheet 206 is folded about the bottom seam of sheets 202, 204, to form legs 210, 212. Vertical seams 214, 216, 218 and 220 are formed, in the same manner as in the embodiment of FIGS. 9–11. Again, there are three long chambers formed, by seams 214, 216, 218 and 220, between sheets 202 and 204, and three short sheets across, between sheet 202 and leg 210, and between sheet 204 and leg 212. Placement of the articles to be packaged, and the indicia bearing cards, may be accomplished in the same varieties of ways, as described with respect to the previously-described embodiments. Again, a greater or lesser number of "vertical" seams may be used, to make greater or fewer numbers of chambers extending across the width of the package.

Figure 17:
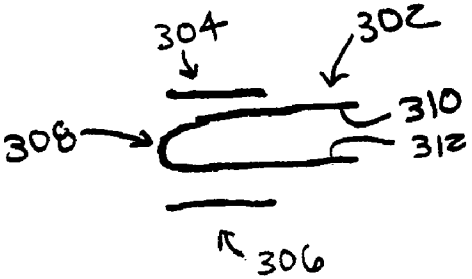
FIG. 17 is a side elevation of the exploded assembly of FIG. 15.
Figure 15:
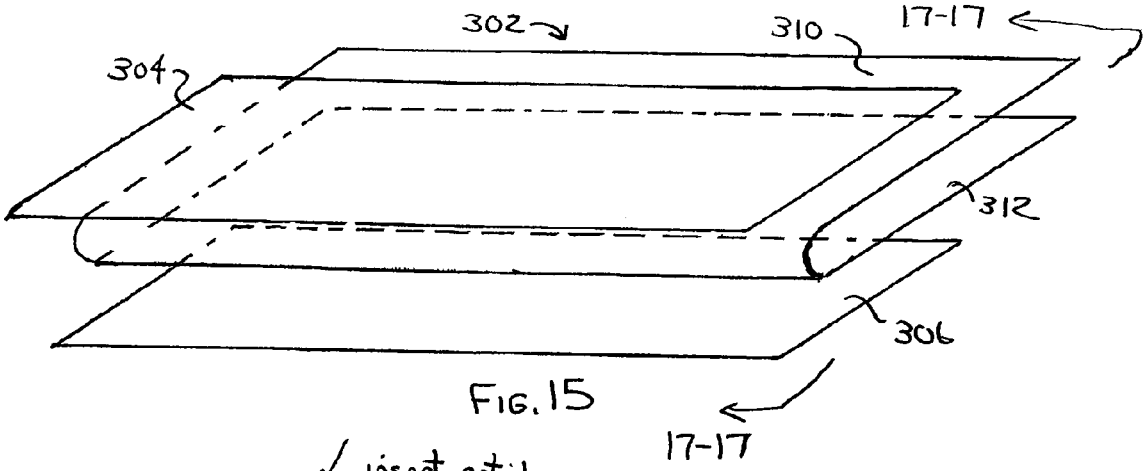
FIG. 15 is a perspective exploded view of two components of a package for similar articles, according to an still another alternative preferred embodiment of the invention.
Figure 16:
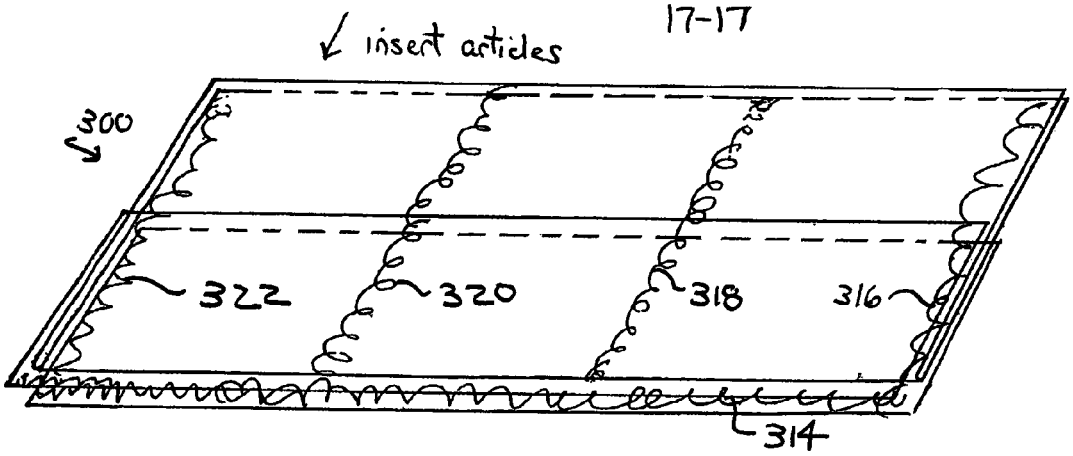
FIG. 16 is a perspective view of a package according to the embodiment of FIG. 15, with the indicia bearing sheets and articles to be packaged omitted.

A further alternative embodiment is shown in FIGS. 15–17, wherein package 300 is formed from folded sheet 302, and sheets 304, 306. Sheet 302 is folded at fold 308, to form legs 310, 312. Then sheets 304, 306 are aligned over legs 310, 312 as shown. Sheets 304, 306 are joined together along fold 308, to form seam 314. Vertical seams 316, 318, 320 and 322 are then created, to form long chambers between legs 310, 312, and to form short chambers between leg 310 and sheet 304, and between leg 312 and sheet 306. Placement of the articles to be packaged, and the indicia bearing cards, may be accomplished in the same varieties of ways, as described with respect to the previously-described embodiments. Again, a greater or lesser number of "vertical" seams may be used, to make greater or fewer numbers of chambers extending across the width of the package.

Figure 20:
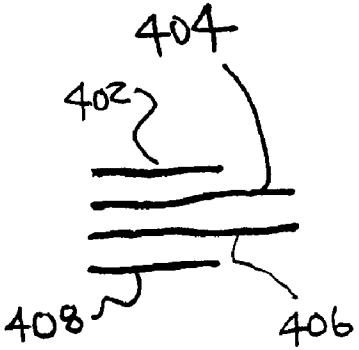
FIG. 20 is a side elevation of the exploded assembly of FIG. 18.
Figure 18:
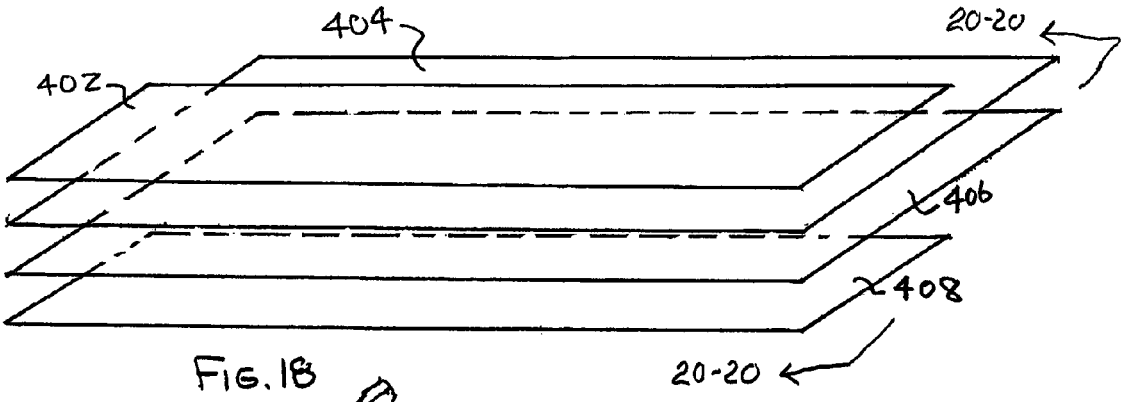
FIG. 18 is a perspective exploded view of two components of a package for similar articles, according to an yet another alternative preferred embodiment of the invention.
Figure 19:
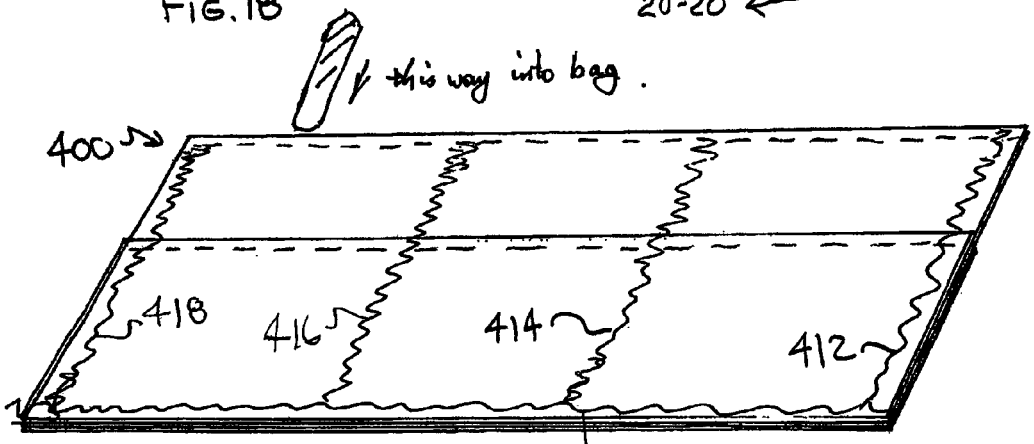
FIG. 19 is a perspective view of a package according to the embodiment of FIG. 18, with the indicia bearing sheets and articles to be packaged omitted.

A still further alternative embodiment of the invention is illustrated in FIGS. 18–20. Four sheets 402, 404, 406 and 408 are provided, which are arranged in overlying fashion as shown in FIGS. 18 and 20. The sheets are then attached to one another by one of the methods previously described, to form seams 410, 412, 414, 416 and 418, again to form long chambers between sheets 404 and 406, and short chambers between sheets 402, 404 and between sheets 406, 408. Placement of the articles to be packaged, and the indicia bearing cards, may be accomplished in the same varieties of ways, as described with respect to the previously-described embodiments. Again, a greater or lesser number of "vertical" seams may be used, to make greater or fewer numbers of chambers extending across the width of the package.

In the embodiments of FIGS. 9–20, the sheets that make up the inner and outer layers of the packages are preferably fabricated from a suitable, sealable plastic material, that may be heat, ultrasonic or RF sealed, and which may be transparent, translucent or, at least in places opaque. The sheets may be fabricated from material upon which indicia may be printed.

The foregoing description and drawings merely explain and illustrate the invention, and the invention is not limited thereto, except as those skilled in the art who have the present disclosure before them will be able to make modifications and variations therein without departing from the scope of the invention.

The invention claimed is:

1. A package of a plurality of like articles, having a longitudinal axis and a transverse axis, the package comprising:

first and second inner layers, each having a width, extending along the transverse axis, and a height, extending along the longitudinal axis, the first and second inner layers being joined to one another along at least three longitudinally extending closure lines to form at least two inner chambers, for receiving articles to be packaged, the at least two inner chambers being bounded by the at least three closure lines and the first and second inner layers, the first and second inner layers being joined at least along respective bottom edge regions thereof;

first and second outer layers, each having a width, extending along the transverse axis, and a height extending along the longitudinal axis, the first and second outer layers being disposed adjacent the first and second inner layers, respectively, the first and second outer layers being joined to their respective adjacent first and second inner layers along at least two longitudinally extending closure lines to form at least one outer chamber, the first and second outer layers being joined, either directly or indirectly, at least along respective bottom edge regions thereof;

a plurality of articles disposed in a first one of the at least two inner chambers, and at least one article disposed in a second one of the at least two inner chambers wherein the first and second outer layers have widths that are less than the widths of the first and second inner layers.

2. A package of a plurality of like articles, having a longitudinal axis and a transverse axis, the package comprising:

first and second inner layers, each having a width, extending along the transverse axis, and a height, extending along the longitudinal axis, the first and second inner layers being joined to one another along at least three longitudinally extending closure lines to form at least two inner chambers, for receiving articles to be packaged, the at least two inner chambers being bounded by the at least three closure lines and the first and second inner layers, wherein a first of the at least three longitudinally extending closure lines is disposed between a second and third of the at least three longitudinally extending closure lines, with the first closure line being disposed substantially closer to one of the second and third closure lines than to the other of the second and third closure lines to create at least one inner chamber having a width substantially less than at least one other inner chamber, the first and second inner layers being joined at least along respective bottom edge regions thereof;

first and second outer layers, each having a width, extending along the transverse axis, and a height extending along the longitudinal axis, the first and second outer layers being disposed adjacent the first and second inner layers, respectively, the first and second outer layers being joined to their respective adjacent first and second inner layers along at least two longitudinally extending closure lines to form at least one outer chamber, the first and second outer layers being joined, either directly or indirectly, at least along respective bottom edge regions thereof;

a plurality of articles disposed in a first one of the at least two inner chambers, and at least one article disposed in a second one of the at least two inner chambers, wherein the plurality of articles disposed in the first one of the at least two inner chambers, are all like articles, and the at least one article disposed in the second one of the at least two inner chambers is of the same type as those of the plurality of like articles, and another permanent seal extending laterally across at least one of the at least two inner chambers, at a position above the top edges of the first and second outer layers, to join at least portions of the first and second inner layers to each other, to maintain any articles therewithin.

3. A package of a plurality of like articles, having a longitudinal axis and a transverse axis, the package comprising:

first and second inner layers, formed from separate discrete sheets of material, each of the first and second inner layers having a width, extending along the transverse axis, a height, extending along the longitudinal axis, and a top edge, two side edges and a bottom edge, the first and second inner layers being joined to one another along at least three longitudinally extending closure lines to form at least two inner chambers, for receding articles to be packaged, the at least two inner chambers being bounded by the at least three closure lines and the first and second inner layers, wherein a first of the at least three longitudinally extending closure lines is disposed between a second and third of the at least three longitudinally extending closure lines, with the first closure line being disposed substantially closer to one of the second and third closure lines than to the other of the second and third closure lines to create at least one inner chamber having a width substantially less than at least one other inner chamber, first and second outer layers, formed from separate discrete sheets of material, each of the first and second outer layers having a width, extending along the transverse axis, and a height extending along the longitudinal axis, and a top edge, two side edges and a bottom edge, the first and second outer layers being disposed adjacent the first and second inner layers, respectively, the first and second outer layers, and first and second inner layers being joined to one another along permanent seals along their respective aligned bottom and side edges, in part, to define at least one outer chamber disposed between at least one of the first and second outer layers and their respective adjacent first and second inner layers, a plurality of articles disposed in a first one of the at least two inner chambers, and at least one article disposed in an other one of the at least two inner chambers, wherein the plurality of articles and the at least one article are all of the same type;

another permanent seal extending laterally across at least one of the at least two inner chambers, at a position above the top edges of the first and second outer layers, to join at least portions of the first and second inner layers to each other, to maintain any articles therewithin;

wherein the heights of the first and second outer layers are less than the heights of the first and second inner layers.

4. The package according to claim 3, wherein each of the first and second inner layers and first and second outer layers is one of: transparent, translucent, opaque.

5. The package according to claim 3, further comprising: at least one sheet disposed in at least one outer chamber.

6. The package according to claim 5, wherein the at least one sheet has indicia disposed thereon.

7. The package according to claim 3, wherein the bottom edge regions of the first and second inner layers are disposed proximate the bottom edge regions of the first and second outer layers.

8. A method for forming a package of a plurality of like articles, having a longitudinal axis and a transverse axis, the method comprising the steps of:

forming first and second inner layers, each having a width, extending along the transverse axis, and a height, extending along the longitudinal axis, joining the first and second inner layers to one another along at least three longitudinally extending closure lines to form at least two inner chambers, for receiving articles to be packaged, the at least two inner chambers being bounded by the at least three closure lines and the first and second inner layers, wherein a first of the at least three longitudinally extending closure lines is disposed between a second and third of the at least three longitudinally extending closure lines, with the first closure line being disposed substantially closer to one of the second and third closure lines than to the other of the second and third closure lines to create at least one inner chamber having a width substantially less than at least one other inner chamber, joining the first and second inner layers at least along respective bottom edge regions thereof;

forming first and second outer layers, each having a width, extending along the transverse axis, and a height extending along the longitudinal axis, disposing the first and second outer layers adjacent the first and second inner layers, respectively, joining the first and second outer layers to their respective adjacent first and second inner layers along at least two longitudinally extending closure lines to form at least one outer chamber, joining the first and second outer layers, either directly or indirectly, at least along respective bottom edge regions thereof;

placing a plurality of articles in a first one of the at least two inner chambers, and placing at least one article in a second one of the at least two inner chambers, and further comprising the steps of selecting the plurality of articles disposed in the first one of the at least two Inner chambers, to be all like articles, and selecting the at least one article disposed in the second of the at least two inner chambers to be of the same type as those of the plurality of like articles, and placing another permanent seal extending laterally across at least one of the at least two inner chambers, at a position above the ton edges of the first and second outer layers, to join at least portions of the first and second inner layers to each other. to maintain any articles therewithin.

9. A method for forming a package of a plurality of like articles, having a longitudinal axis and a transverse axis, the method comprising the steps of:

forming first and second inner layers, from separate discrete sheets of material, each of the first and second inner layers having a width, extending along the transverse axis, a height; extending along the longitudinal axis, and a top edge, two side edges and a bottom edge, joining the first and second inner layers to one another along at least three longitudinally extending closure lines to form at least two inner chambers, for receiving articles to be packaged, the at least two inner chambers being bounded by the at least three closure lines and the first and second inner layers, wherein a first of the at least three longitudinally extending closure lines is disposed between a second and third of the at least three longitudinally extending closure lines, with the first closure line being disposed substantially closer to one of the second and third closure lines than to the other of the second and third closure lines to create at least one inner chamber having a width substantially less than at least one other inner chamber, forming first and second outer layers, from separate discrete sheets of material, each of the first and second outer layers having a width, extending along the transverse axis, and a height extending along the longitudinal axis, and a top edge, two side edges and a bottom edge, disposing the first and second outer layers adjacent the first and second inner layers, respectively, joining the first and second outer layers, and the first and second inner layers to one another along permanent seals along their respective aligned bottom and side edges, in part, to define at least one outer chamber disposed between at least one of the first and second outer layers and their respective adjacent first and second inner layers, disposing a plurality of articles in a first one of the at least two inner chambers, and disposing at least one article in an other one of the at least two inner chambers, wherein the plurality of articles and the at least one article are all of the same type;

placing another permanent seal laterally across at least one of the at least two inner chambers, at a position above the top edges of the first and second cuter layers, to join at least portions of the first and second inner layers to each other, to maintain any articles therewithin;

wherein the heights of the first and second outer layers are less than the heights of the first and second inner layers.

10. The method according to claim 9, further comprising the step of forming each of the first and second inner layers and first and second outer layers as one of: transparent, translucent, opaque.

11. The method according to claim 9, further comprising the step of placing at least one sheet in at least one outer chamber.

12. The method according to claim 9, further comprising the step of placing indicia on the at least one sheet.

13. The method according to claim 9, further comprising the step of:

forming a further closure line, extending transversely across and sealing joining top edge regions of the first and second inner layers.

14. The method according to claim 9, further comprising the step of positioning the bottom edge regions of the first and second inner layers proximate the bottom edge regions of the first and second outer layers.

15. A method for forming a package of a plurality of like articles, having a longitudinal axis and a transverse axis, the method comprising the steps of:

forming first and second inner layers, each having a width, extending along the transverse axis, and a height, extending along the longitudinal axis, joining the first and second inner layers to one another along at least three longitudinally extending closure lines to form at least two inner chambers, for receiving articles to be packaged, the at least two inner chambers being bounded by the at least three closure lines and the first and second inner layers, joining the first and second inner layers at least along respective bottom edge regions thereof;

forming first and second outer layers, each having a width, extending along the transverse axis, and a height extending along the longitudinal axis, disposing the first and second outer layers adjacent the first and second inner layers, respectively, joining the first and second outer layers to their respective adjacent first and second inner layers along at least two longitudinally extending closure lines to form at least one outer chamber, joining the first and second outer layers, either directly or indirectly, at least along respective bottom edge regions thereof;

placing a plurality of articles in a first one of the at least two inner chambers, and placing at least one article in a second one of the at least two inner chambers, and further comprising the step of providing the first and second outer layers with widths that are less than the widths of the first and second inner layers.

* * * * *